United States Patent [19]

Harvey

[11] Patent Number: 4,763,452

[45] Date of Patent: Aug. 16, 1988

[54] ROOF SEALING AND INSULATING SYSTEM

[76] Inventor: Albert S. Harvey, 267 Bombay Ave., Lauderdale By The Sea, Fla. 33308

[21] Appl. No.: 32,533

[22] Filed: Apr. 1, 1987

[51] Int. Cl.[4] ..... E04D 13/00

[52] U.S. Cl. ..... 52/96; 52/222; 52/747; 24/462; 160/395

[58] Field of Search ..... 52/63, 94, 222, 287, 52/309.1, 408, 22, 96, 746, 747, 741; 24/460–462; 160/391, 392, 395

[56] References Cited

U.S. PATENT DOCUMENTS

| | | | |
|---|---|---|---|
| 3,421,276 | 1/1969 | La Barge | 52/287 |
| 3,851,848 | 12/1974 | Wiele | 248/273 |
| 4,424,650 | 1/1984 | Van Note | 52/96 |
| 4,566,236 | 1/1986 | Pound | 52/222 |

FOREIGN PATENT DOCUMENTS

| | | | |
|---|---|---|---|
| 2820731 | 11/1978 | Fed. Rep. of Germany | 52/222 |
| 1067862 | 6/1954 | France | 52/287 |
| 2236071 | 3/1975 | France | 52/222 |

*Primary Examiner*—John E. Murtagh
*Assistant Examiner*—Andrew Joseph Rudy
*Attorney, Agent, or Firm*—Alvin S. Blum

[57] ABSTRACT

A process and a system for applying insulation and water sealing to roofs such as house trailers includes a sealing strip that fastens completely around the upper wall. This strip seals the edges of successive layers of a first waterproof membrane, a layer of thermal insulation and a second waterproof membrane. The combination provides a layer of thermal insulation completely enclosed in waterproof membranes. This maintains the effectiveness of the insulation by preventing the entry of moisture. The system permits use of readily available, inexpensive materials. The system may be applied by the owner because it requires no special tools or skills.

19 Claims, 4 Drawing Sheets

FIG. 4
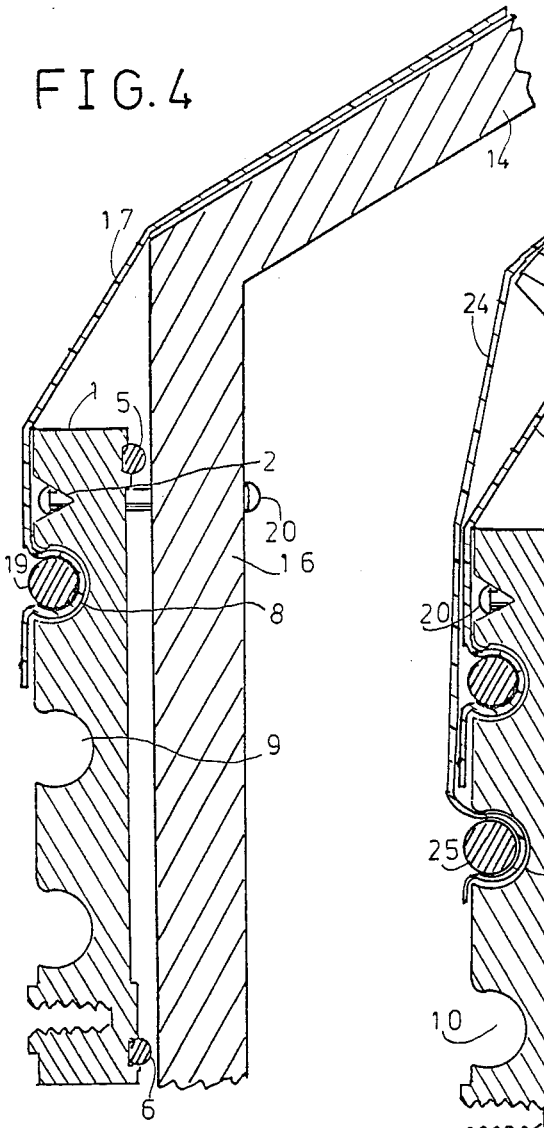
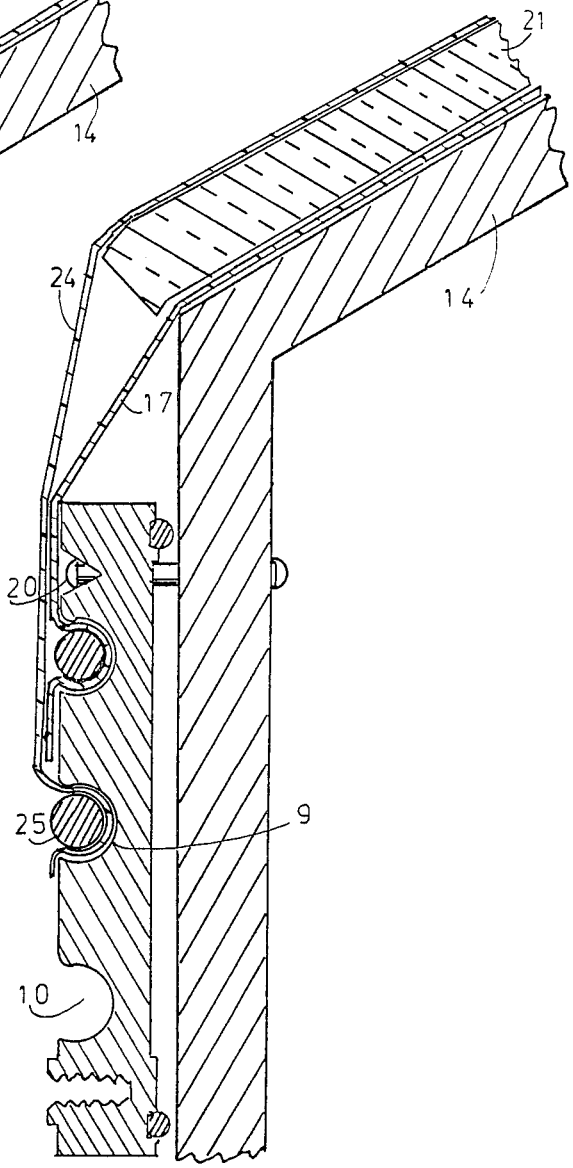
FIG. 5

FIG. 6
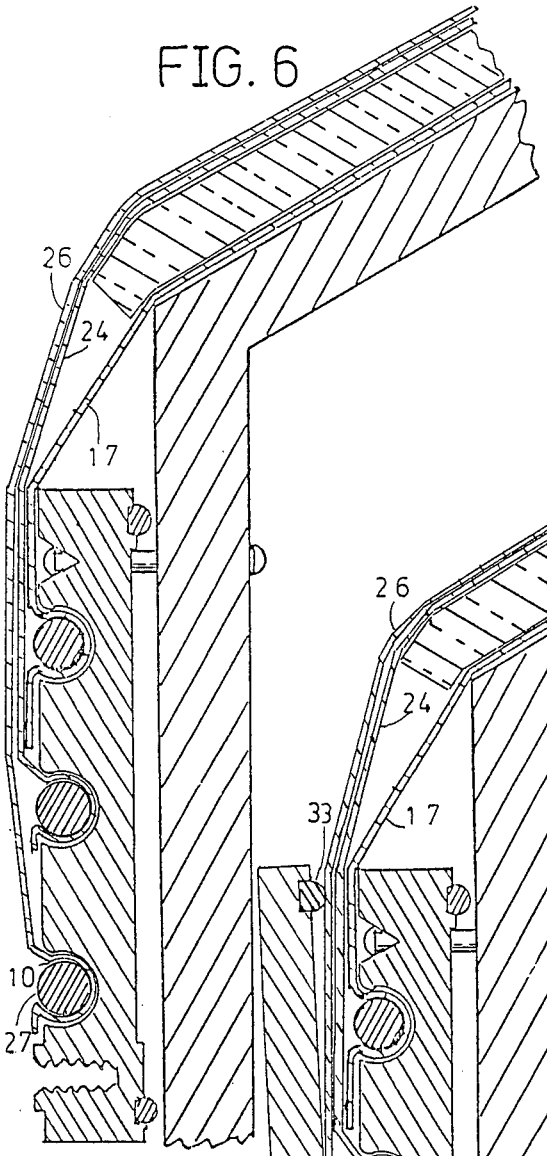
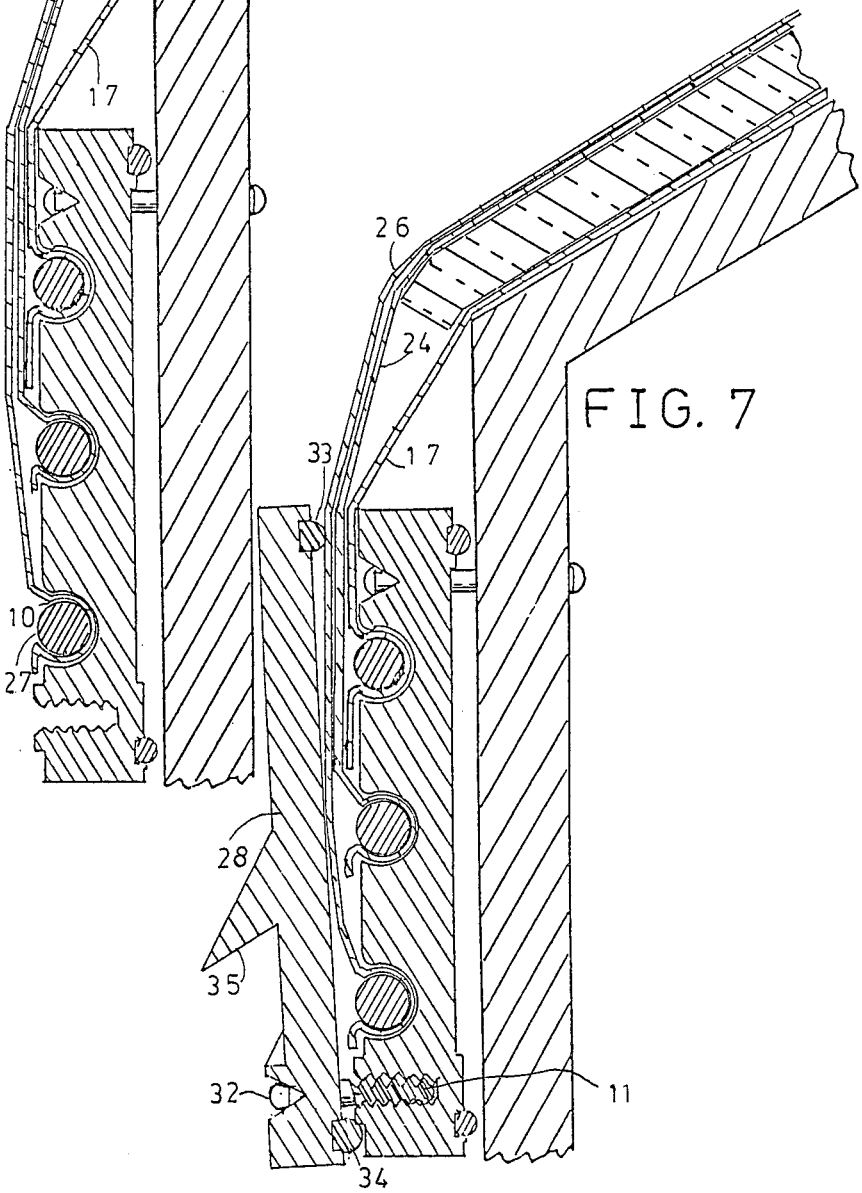
FIG. 7

ROOF SEALING AND INSULATING SYSTEM

This invention relates to methods and apparatus for sealing and insulating roofs and more particularly to systems employing inexpensive waterproof membranes and insulating materials to repair leaky and poorly insulated roofs of house trailers and other habitations with simple tools requiring minimal skills.

BACKGROUND OF THE INVENTION

House trailers and other inexpensive residential structures are often manufactured with inadequate roofs and roof insulation. The costs of heating and cooling these structures are excessive. Furthermore, in cold weather the moisture generated internally condenses on the ceiling, or within the insulation if the insulation is not sealed from the inside. The problems are compounded by leaks in the roof which may allow rain water to saturate the insulation. Water destroys its insulating properties. Access to the insulating space between roof and ceiling is generally not feasible to replace or add insulation. Consequently, repair of leaky roofs and provision of adequate insulation are expensive problems for people who can least afford them.

SUMMARY OF THE INVENTION

It is, accordingly, an object of the invention to provide a system of waterproof sealing and insulating of a roof that is external to the original roof for ease of application.

It is a further object to provide a system that can be applied by individuals without special skills such as a do-it-yourself kit and process.

It is a further object to provide a system that includes at least three layers to the existing roof: (a) a first, complete waterproof sealing layer against the roof; (b) a second, insulating layer covering the roof; and (c) a third, complete waterproof sealing layer over the insulation tha seals the insulation completely between the two waterproof layers so that moisture cannot enter the insulation from above or below.

The invention includes a unique edge-sealing means that fastens to the upper walls, continuously encircling the structure below the roof. This edge sealing means enables the unskilled operator to use inexpensive membranes and roll insulation to fix the membranes and insulation in place and seal them together with ordinary tools. An optional cover means can be applied to further secure the sealing means and provide a drip strip so that water does not run down the walls. The invention provides means for securing the edge sealing means to the trailer. And the edge sealing means is so arranged that any leakage at the points of securing to the trailer will not result in moisture leaking into the insulation or into the residential structure.

These objects and advantages and others will become apparent to those skilled in the art from the following disclosure of the preferred embodiment of the invention taken in conjunction with the accompanying drawings.

BRIEF DESCRIPTION OF THE DRAWINGS

FIG. 4 is a cross section view through plane 4—4 of FIG. 1.

FIG. 5 is a cross section view through plane 5—5 of FIG. 1.

FIG. 6 is a cross section view through plane 6—6 of FIG. 1.

FIG. 7 is a cross section view through plane 7—7 of FIG. 1.

DETAILED DESCRIPTION OF THE PREFERRED EMBODIMENT

Figure 3:
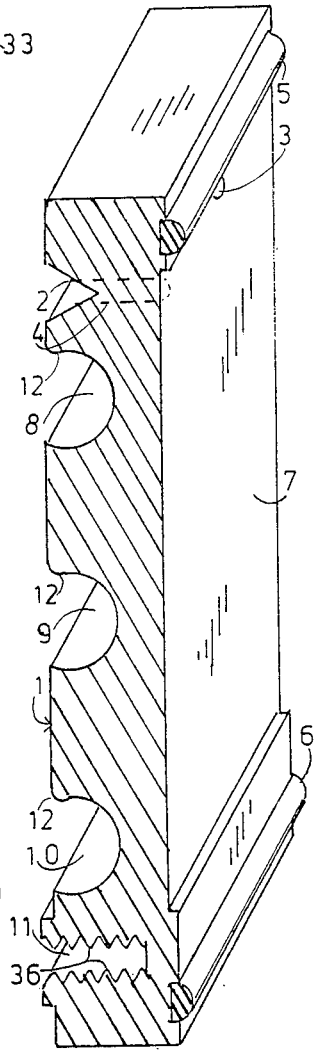
FIG. 3 is a perspective view in partial cross section of the sealing strip.

Referring first to FIG. 3 wherein is illustrated a short length of the sealing strip 1, which is a profile extrusion of a corrosion resistant metal such as aluminum or a plastic such as polyvinyl chloride that can be inexpensively produced in quantity. A v-shaped groove 2 provides a guide for drilling periodic holes 3 through the strip for securing the strip to the upper wall 16 of trailer 13 (FIG. 1) by screws, bolts, blind rivets or other fastening means. The groove 2 countersinks the head of the rivet below the surface of the strip 1. Phantom lines 4 (FIG. 3) indicate the path of a hole that might be drilled at the level of the cross section. These fastener holes may be drilled at various locations along the length of the strip at the discretion of the user to best anchor the strip to the structure, such as at vertical studs. Resilient elements 5 and 6 may seal the strip tightly against the structure when fasteners are secured to stop the entry of water. The sealing surface 7 may include adhesive or an adhesive caulking material may be used in conjunction with or in place of elements 5 and 6. The elements 5 and 6 may alternatively be of the same material as the strip itself. An effective adhesive on surface 7 may eliminate the need for fasteners and fastener holes in strip and structure. Three receiving channels 8,9 and 10 are shown in the strip for receiving webs of material to be sealed in place by resilient splines in a manner well known in the art of window screens. Webs may be replaced without disturbing the strip.

Each channel has a gently curving upper edge 12 to prevent accidental cutting of the web secured in the channel. A screw-receiving slot 11 has longitudinal internal ridges 36 that provide easy insertion and holding of self-tapping machine screws without requiring hole drilling that might penetrate the strip.

Figure 1:
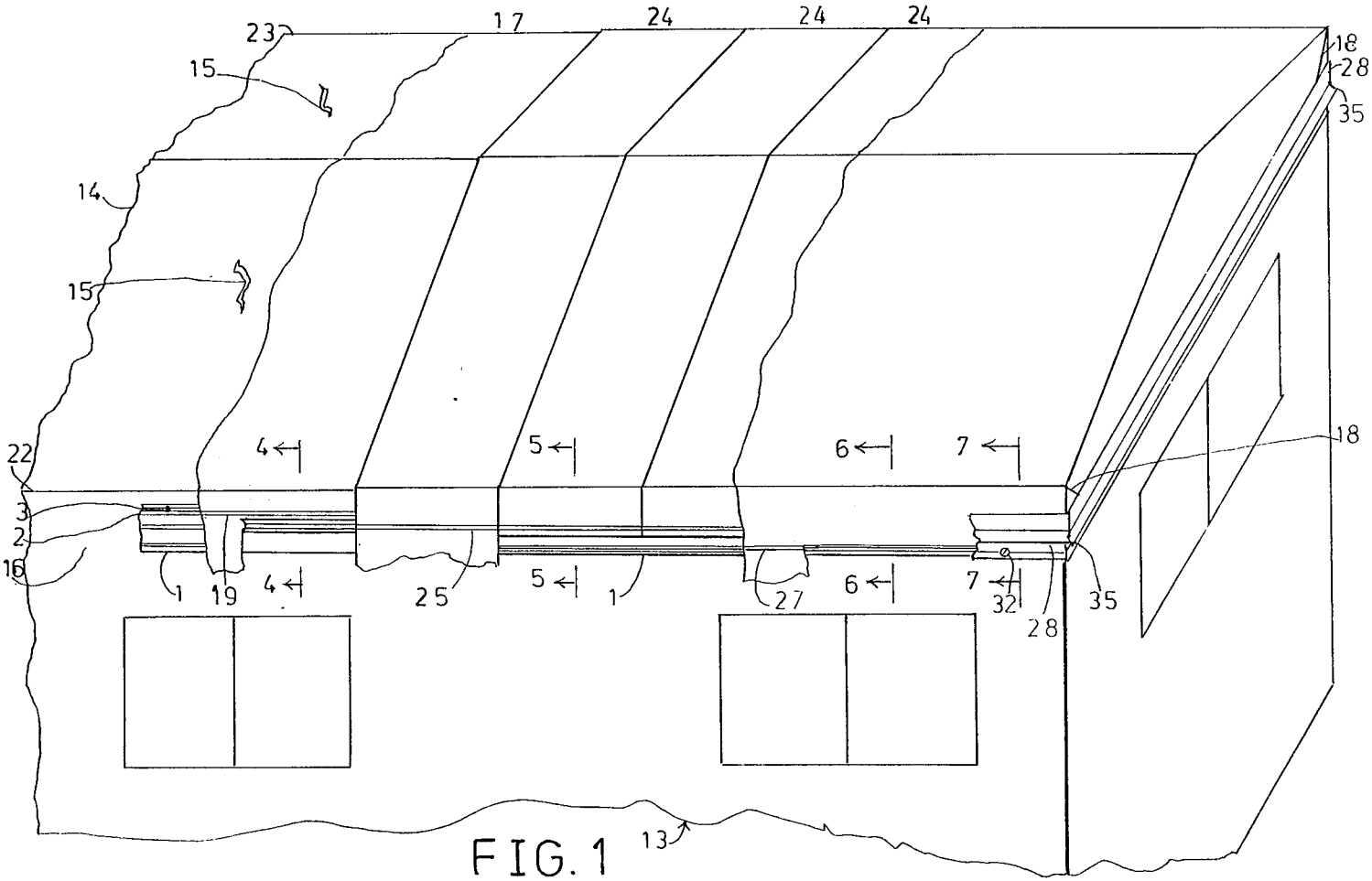
FIG. 1 is a perspective view of a portion of a house trailer with the invention in place with various portions broken away to illustrate the layered application to a leaky roof.

Referring now to FIG. 1, a typical house trailer 13 has a roof 14 with leaking holes 15. These leaks not only allow water to enter the living space, but also to penetrate the roof insulation, rendering it ineffective. Because the insulation is inaccessible, it is costly to replace when repairing the roof by conventional methods.

The process of installing new insulation and waterproofing using the instant invention is illustrated by breaking away successive layers. The sealing strip 1 is first secured permanently continuously all around the upper wall 16 of trailer 13. This may include drilling holes 3 through strip 1 at groove 2 and use of adhesive sealant. The hole may be drilled into or through the trailer wall to receive screws or rivets. Next a web of waterproof material is drawn completely over the roof. This is a seamless membrane large enough to cover the entire roof and extend down over the strip on all sides. Since this first membrane will be covered by other materials, it need not provide great resistance to external trauma. Polyethylene films of this size, often used as construction and agricultural covers because of the low cost, are readily available and are relatively permanent in this application. At the corners 18, they may be folded over much like the "hospital corner" for bedsheets to make a snug, seamless corner. As shown in the detail of FIG. 4, a spline 19 is forced into channel 8 over the membrane to continuously seal the membrane water tight into the channel. Blind rivet 20, countersunk in groove 2 secures the strip 1 to wall 16. For clarity of illustration, the strip is not shown tight against the wall with resilient elements 5 and 6 deformed to a weatherstrip seal as they would be in actual use. Furthermore, the channels 8,9 and 10 would preferably be closer together than herein illustrated. After sealing membrane 17 water tight into channel 8 with spline 19, the membrane is trimmed off just below the spline to expose channel 9. It can be seen that this process provides a complete continuous seamless watertight cap for the roof that extends down below any holes 3 drilled for fasteners as well as any roof leaks.

Next, a layer of thermal insulation is applied to the roof. This may be in the form of fiberglass insulation three inches thick supplied in rolls four feet wide. To facilitate installation, this is cut into lengths that extend transversely across the roof from edge 22 to edge 23. These strips of insulation are fastened with tape or adhesive to strips of plastic 24 that are long enough to extend over strip 1 and be reached from ground level. Alternatively, the plastic strip may be cut to twice the width of the insulation and folded over it to envelop the insulation. The plastic strip 24 holds the insulation 21 firmly down on the roof (FIG. 5) and it is inserted into the second channel 9 of sealing strip 1 and secured by spline 25. The strips of insulation are butted tightly against each other along their length to ensure a complete layer of insulation over the roof. To seal all of these seams water-tight would be a difficult task. Instead, an additional waterproof membrane 26 without seams is now placed over the insulation and sealed in place in the continuous third channel 10 by spline 27, thereby forming a complete waterproof chamber enclosing all insulation top and bottom without seams and sealed water-tight continuously along its edges by sealing strip 1 (FIG. 6). Furthermore, the water-tight assembly caps the entire roof and securing holes. This outer membrane 26 may be of a more sturdy composition to resist damage from external forces. It may be formed of fiber reinforced polyethylene or vinyl coated nylon. In an alternative embodiment, not shown, the membrane 26 may also be an inexpensive polyethylene film and an additional layer of heavy fabric may be applied to the surface and sealed into a fourth channel in strip 1. This fabric need not be seamless or waterproof since it acts only as a protection for the waterproof membrane 26.

Figure 2:
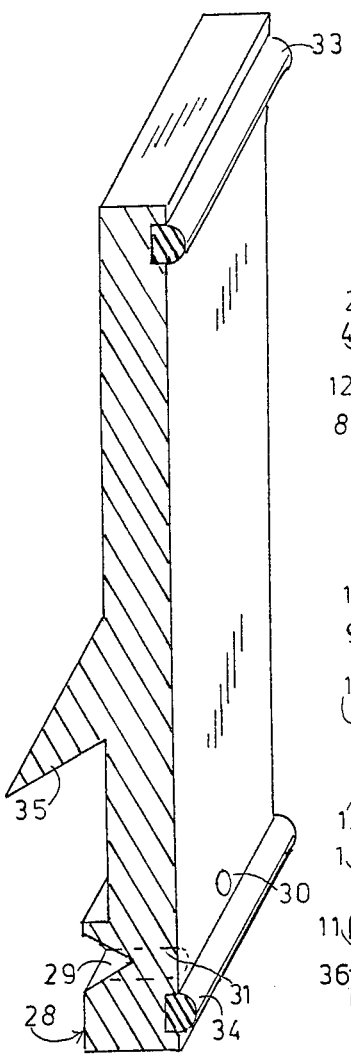
FIG. 2 is a perspective view in partial cross section of the cover element for the sealing strip.

It may be desirable to protectively cover the sealing splines after the membranes have been installed with cover strip 28 (FIGS. 2,7,1). Cover strip 28 includes top and bottom resilient weatherstrips 33 and 34 and a groove 29 that serves as a guide for drilling holes 30 as indicated by phantom lines 31 at the level of the cross section in FIG. 2. The drilled hole receives a self-tapping screw 32 which engages the serrated slot 11 in sealing strip 1, while the groove provides a countersink for the head of the screw 32. A downward projection 35 may be provided to serve as a drip strip to help keep rainwater off the wall. Caulking sealant may also be applied to the finished assembly to further enclose the seals.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea of principles of the invention within the scope of the appended claims.

What is claimed is:

1. A system for waterproofing and insulating a roof of a structure with inexpensive web materials not requiring special skills, comprising sealing strip means for water-tight sealing of said web materials, said sealing strip means including:

(a) strip securing means for attaching said strip means to the upper exterior walls of said structure;

(b) first web-receiving channel means positioned below said strip securing means;

(c) second web-receiving channel means positioned below said first channel means;

(d) third web-receiving channel means positioned below said second channel means;

(e) each of said web-receiving channel means including means securing said web material in continuous water-tight connection to said strip means and said channel means so arranged in relation to one another that a water-tight connection is made between said webs, wherein said first channel means and said third channel means receive waterproof membrane means and said second channel means receives web means holding thermal insulation providing a roof covering of thermal insulation completely enclosed by waterproof membranes.

2. In the system of claim 1, said securing means including a groove for countersinking fasteners and for guiding a drill for drilling holes for fasteners, wherein said holes will be covered by said waterproof membranes to prevent entry of water into said structure through said holes.

3. In the system of claim 1, said means for securing said web materials in said channels including spline means.

4. In the system of claim 1, said means for securing said web materials in said channel means providing for replacing said web materials without damage to said strip means.

5. In the system of claim 3, said means for securing said web materials in said channel means providing for replacing said web materials without damage to said strip means.

6. The system of claim 1 further comprising strip cover means for protectively covering said strip means after said web materials have been installed and said strip means further including cover fastener retaining means for fastening said cover means in place with cover fasteners.

7. In the system of claim 6, said cover means further including drip strip means to divert water from a wall of said structure.

8. In the system of claim 6, said cover fastener retaining means including a slot in said strip means positioned below said channel means to prevent said cover fasteners from damaging said web means.

9. In the system of claim 8, said slot means including longitudinal ridges to facilitate engagement of said cover fasteners.

10. In the system of claim 1, said strip means further comprised of a profile extrusion.

11. In the system of claim 1, said strip means further including a plurality of resilient weatherstrip means on surface applied to said wall to keep water out of the connection to said wall.

12. In the system of claim 6, said cover means including a plurality of resilient weatherstrip means on surface applied to said strip means to keep water out of the connection between said cover means and said strip means.

13. In the system of claim 10, said profile extrusion composed of an aluminum alloy.

14. In the system of claim 10, said profile extrusion composed of a thermoplastic material.

15. The system of claim 1, including at least one additional web-receiving channel means below said third channel means for receiving a web of sturdy material resistant to external trauma to permit the use of an inexpensive waterproof membrane for covering said insulation in said third channel means.

16. A process of insulating and waterproofing the roof of a structure with inexpensive materials and unskilled labor that seals insulating material within a water tight envelope, comprising the steps of:

(a) fastening a sealing strip to the upper exterior walls of said structure to encircle said roof;

(b) covering said roof completely with a first waterproof membrane that extends down below said sealing strip on all sides;

(c) sealing said first waterproof membrane in continuous water-tight connection with said sealing strip in a first channel in said sealing strip;

(d) covering said roof over said first waterproof membrane with a layer of thermal insulation supported upon insulation-supporting web means, wherein said insulationsupporting web means extends down below said sealing stip;

(e) sealing said insulation-supporting web means in connection with said sealing strip in a second channel in said sealing strip;

(f) covering said roof over said layer of thermal insulation with a second waterproof membrane that extends down below said sealing strip on all sides;

(g) sealing said second waterproof membrane in continuous water-tight connection with said sealing strip in a third channel in said sealing strip, thereby sealing continuously said first membrane and said second membrane in water-tight connection along their edges at said sealing strip to form a water-tight envelope for enclosing said thermal insulation and said envelope thereby forming a waterproof cap over said roof preventing moisture from entering both said insulation and said structure and also preventing moisture within said structure from condensing within said insulation.

17. The process of claim 16 further including the step of covering said sealing strip with a covering strip after said membranes have been secured in place to prevent damage to said sealing strip and said membranes.

18. In the process of claim 16, the step of fastening said sealing strip further including fastening said sealing strip with fasteners through holes drilled in said sealing strip above the level of said first channel to ensure that said holes will be covered by said membranes to prevent leaks.

19. The process of claim 16 further including the additional steps of:

applying over said second waterproof membrane a layer of sturdy web material that extends down below said sealing strip on all sides to protect said membrane from damage;

and sealing said sturdy web material in a fourth channel in said sealing strip.

* * * * *